United States Patent [19]

Varga

[11] Patent Number: 4,817,935

[45] Date of Patent: Apr. 4, 1989

[54] PLAY ENCLOSURE FOR ARTWORK, PAPERWORK, SAND AND WATER PLAY USE

[76] Inventor: Nevada Varga, R.D. #2, Box 401 A, Milford, N.J. 08848

[21] Appl. No.: 180,524

[22] Filed: Apr. 12, 1988

[51] Int. Cl.[4] ..... A63G 31/00

[52] U.S. Cl. ..... 272/1 A; 272/1 R

[58] Field of Search ..... 272/1 A, 1 B, 1 C, 1 R, 272/2, 3; D21/252; 4/488, 506

[56] References Cited

U.S. PATENT DOCUMENTS

| | | | |
|---|---|---|---|
| D. 245,357 | 8/1977 | Burgess et al. . | |
| D. 277,300 | 1/1985 | Appel et al. . | |
| 1,018,373 | 2/1912 | Robbins . | |
| 1,865,810 | 1/7932 | Arbach | 272/1 A |
| 2,199,915 | 5/1940 | Howard . | |
| 2,423,955 | 7/1947 | Widener . | |
| 2,673,086 | 3/1954 | Brown, Sr. . | |
| 2,724,123 | 11/1955 | Kesler | 272/1 A X |
| 2,886,828 | 5/1959 | Lattuca . | |
| 3,006,705 | 10/1961 | Williams et al. | 272/1 A X |
| 3,454,272 | 7/1969 | Elkington et al. . | |
| 3,881,723 | 5/1975 | Boynton | 272/1 R X |
| 4,045,019 | 8/1977 | Wade | 272/1 A |
| 4,507,244 | 11/1977 | Gasper . | |

OTHER PUBLICATIONS

1988 Holbrook Catalog–pp. 13 and 15.

*Primary Examiner*—John E. Murtagh
*Assistant Examiner*—Richard E. Chilcot, Jr.
*Attorney, Agent, or Firm*—Steele, Gould & Fried

[57] ABSTRACT

A play enclosure for interchangeable use as an artwork center, paper cutting and coloring area, a sand and water play enclosure includes an open top, rectilinear, box-like structure having short side walls as compared with a length and a width of the rectilinear structure. A peripheral shelf slopes inwardly from peripheral top edges of all sides of the open top of the rectilinear structure. The top surface of the peripheral shelf is spaced from a bottom of the enclosure and has an inward extension wide enough to function as a child's seat and a child's table surface. The peripheral shelf, in a preferred embodiment, has two corner cut-outs, at diametrically opposite corner regions of the peripheral shelf, adjacent an intersection of two side walls of the rectilinear structure. Each cut-out has a mouth open to a center region of the rectilinear structure. The shelf defines about the periphery of each cut-out, a peripheral groove open to the top surface of the shelf. Two discrete, removable corner elements have depending lips that matingly seat within the peripheral groove such that the elemental top surface of each corner element is coplanar with the top surface of the peripheral shelf. One of the corner elements has a cup for holding instruments such as crayons, scissors and the like, and a receptacle for a supply of paper. Another corner element is a strainer for sand or water.

16 Claims, 1 Drawing Sheet

PLAY ENCLOSURE FOR ARTWORK, PAPERWORK, SAND AND WATER PLAY USE

BACKGROUND OF THE INVENTION

1. Field of the Invention

The present invention relates to an enclosure to be used with sand or water as a play enclosure, sandbox or play pool, preferably for indoor use in nursery school or home settings. Removable corner elements are provided for fitting in a receiving structure. A first type of corner element holds writing and cutting instruments for paperwork play by the children and alternately fittable corner elements strain the sand or water. The corners can optionally be fitted with plain seats.

2. Prior Art

Children regularly play in structurally confined areas. Very young children often play in playpens and preschool children play in low box-like enclosures adapted to hold sand and/or water. In the vernacular, these box-like structures are called sandboxes or kiddy pools. When configured for indoor use, sand or water play boxes are conventionally provided with high sides, e.g. two feet, such that the children stand around the box. The high sides keep the sand or water confined. When the box is configured for outside play, children customarily sit on the bottom or on the sides of the box or pool, whether it holds sand or water, and play with toys in a center region of the pool. To further stimulate the child play, the seating area around the pool according to the invention doubles as a table-like structure that confines spillage. Child play is further increased according to the invention by providing interchangeable portions of the seating or table structure adapted for specific use in paperwork, sand and water play. The periphery of the enclosure includes removable corner sections that for paperwork hold crayons, pencils, markers or other such writing instruments, cutting instruments such as scissors, and a supply of paper. The elements can also hold various types of water color or paint. The paperwork corner elements are interchangeable with elements for straining with water or sand, which are in effect fluid mediums, to stimulate the children's play. These elements, which are also useful to separate toys from sand or water, can also be interchangeable with regular seats.

U.S. Pat. No. 2,423,955 to Widener discloses a sandbox having corner seats at the intersection between the low rise sides of a rectilinear, open top box. The seats have depending flanges that cooperate with an outwardly protruding flange on the box. U.S. Pat. No. Des. 277,300 to Appel et al. shows a combined sandbox and sifter having an outwardly extending peripheral shelf and a movable straining bar structure spanning the entire width of the open top, rectilinear box-like structure. U.S. Pat. No. Des. 245,357 to Burgess et al. discloses a sand or water play drum having an inwardly depending peripheral shelf which provides seating for children U.S. Pat. No. 2,886,828 to Lattuca discloses a plastic sand and water pool having uniquely configured corner seats for children. The surfaces of the seats are below the plane of the open top, rectilinear structure. U.S. Pat. No. 2,673,086 to Brown, Sr. discloses a children's collapsible sandbox having laterally extending, removable seats at each end of the open top, rectilinear structure. These seats have side faces depending from the top surfaces of the seats and covering the outside edges of the sandbox. U.S. Pat. No. 3,454,272 to Elkington et al. discloses a child's playpen and sandbox that is circular with a central open region within which a child sits. U.S. Pat. No. 2,199,915 to Howard discloses a child's play bowl with an umbrella vertically disposed above the bowl. U.S. Pat. No. 1,018,373 to Robbins discloses a kindergarten table that includes an open top, rectilinear structure subdivided into a sandbox region and a tabletop region. U.S. Pat. No. 4,047,244 to Gaspar discloses a child's play seat apparatus that is generally a water table with a plurality of play toys disposed above the water table and an integral seat.

OBJECTS OF THE INVENTION

It is an object of the present invention to provide an artwork, paperwork, sand play and water play enclosure that has interchangeable functional corner elements to stimulate children's play from within or around the enclosure for these specific uses.

It is a further object of the present invention to provide such an enclosure wherein the corner elements and the peripheral shelf extending inward around the enclosure are arranged to double as a table for children using the implements retained in the corner elements, whereby the children sit in the enclosure and face outwardly with their legs under the peripheral shelf, or sit outside, facing inward.

It is a further object of the present invention to provide such an enclosure wherein the corner elements and the retained implements can be easily removed from the enclosure and replaced with other functional corner elements.

SUMMARY OF THE INVENTION

The artwork, paperwork, sand play and water play enclosure includes an open top defined by a rectilinear, box-like structure with relatively low side walls as compared with a length and a width of the rectilinear structure. The bottom is continuous, for containing sand or water, and may have a removable plug. A peripheral shelf inwardly extends from peripheral top edges of all sides of the open top of the rectilinear structure, the shelf being spaced from the bottom, for example by about eight inches. The top surface of the peripheral shelf has an inward extension wide enough to function as a child's seat or a child's table surface. However, the peripheral shelf is preferably sloped slightly inwardly such that paper cuttings, sand or water on the shelf tend to fall into the enclosure rather than outside.

The peripheral shelf, in a preferred embodiment, has two corner cut-outs, at diametrically opposite corners of the peripheral shelf adjacent an intersection of two side walls of the rectilinear structure. Each cut-out has a mouth opening toward a center region of the rectilinear structure. The shelf defines, about the periphery of each cut-out, a peripheral groove opening toward the top surface of the shelf. Discrete, removable corner elements adapted for the respective functions of the enclosure have depending peripheral lips that matingly seat within the peripheral groove such that the elemental top surface of each corner element is coplanar with the top surface of the peripheral shelf. One of the corner elements adapted for paperwork has at least one of a cup for holding writing instruments such as crayons, means for holding scissors, glue or the like, and a receptacle for paper supplies. An interchangeable other corner element is a strainer for sand or water placed in the pool, and is useful for storage of toys. A plain seat can also be installed in the corner position(s).

BRIEF DESCRIPTION OF THE DRAWING(S)

Further objects and advantages of the present invention can be found in the detailed description of the preferred embodiments when taken in conjunction with the accompanying drawings in which.

DETAILED DESCRIPTION OF THE PREFERRED EMBODIMENT(S)

The present invention relates to an artwork, paperwork, sand play and water play enclosure adapted for play by children with materials such as paper, crayons, paper cuttings, sand and water. These materials are great fun and are highly educational, but are subject to causing a mess should they be dispersed. These materials also require quite different apparatus with which to play.

Figure 1:
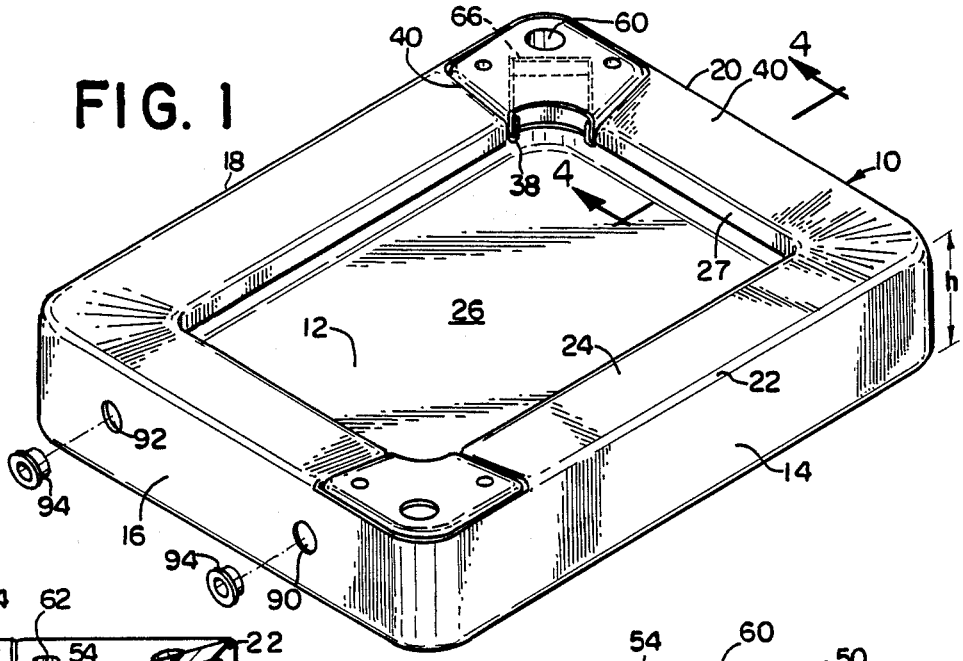
FIG. 1 illustrates a perspective view of the artwork, paperwork, sand play and water play enclosure in accordance with the principles of the present invention, outfit as shown for paperwork.

FIG. 1 is a perspective view of artwork, paperwork, sand play and water play enclosure 10. Enclosure 10 includes bottom 12, continuous and watertight, but preferably provided with a removable drain plug, and four side walls 14, 16, 18 and 20. The bottom and walls define an open top, rectilinear, box-like structure. The height of the side walls is relatively short (e.g. about eight inches) as compared with either the length of enclosure 10 or the width of enclosure 10, each about three to four feet. The side walls include a peripheral top edge 22 that is common to side walls 14, 16, 18 and 20. Perferably, peripheral edge 22 is rounded.

Inwardly extending from peripheral top edge 22 is a peripheral shelf 24. Peripheral shelf 24 extends inboard toward the interior of the enclosure towards central region 26 of enclosure 10.

Figure 2:
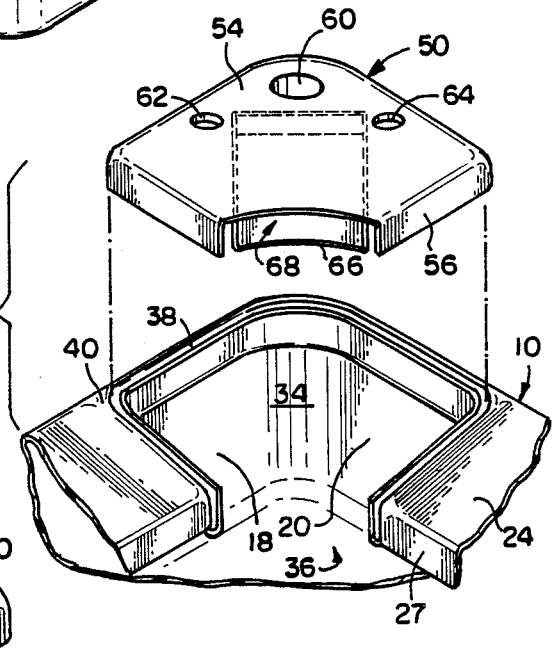
FIG. 2 illustrates a broken away, partial, perspective view of a corner region of the peripheral shelf with one removable corner element.

As shown in FIGS. 1 and 2, cut-out 34 is adjacent an intersection of side wall 18 and side wall 20. Peripheral shelf 24 is wide enough and extends inwardly toward central region 26 enough that it functions as a child's seat and a child's table surface. Preferably, however, shelf 24 also tilts inwardly, for example at 5 to 30 degrees, preferably about 15 degrees.

Cut-out 34 includes a mouth 36 that is open to central region 26. Peripheral shelf 24, about the periphery of cut-out 34, defines a peripheral groove 38 that is open to a top surface 40 of peripheral shelf 24. The cross-section of groove 38 is U-shaped, opening upwardly. The groove extends about the periphery of cut-out 34 in the shelf's top surface and can be discontinuous, i.e., defined by a plurality of U-shaped tab structures around cut-out 34. Top edge 22, however, is preferably continuous around the circumference of enclosure 10. Walls 18, 20, 14 and 16 are continuous as necessary to contain water or sand.

The present invention includes at least two discrete, interchangeable corner elements 50 and 52, adapted for different functions. Corner element 50 has an elemental top surface 54 of substantially the same size and shape as the cut-outs and particularly as cut-out 34, shown in FIG. 2. Corner element 50 includes depending side wall sections to form a lip, one of which is side wall section 56, depending from elemental top surface 54. The height and thickness of the depending elemental said wall section lips is substantially similar to the depth and the width of peripheral groove 38 surrounding most of cut-out 34. This feature enables elemental top surface 54 to be substantially coplanar with top surface 40 of peripheral shelf 24 when corner element 50 is placed in cut-out 34. Wall section 56 need not be continuous, but is sufficiently engaged in groove 38 as to support the weight of a child.

Corner element 50 also includes a means for holding instruments for writing, cutting, coloring etc. which, in the illustrated embodiment, includes cup 60 that depends below elemental top surface 54. Cup 60 can be formed integrally with the corner element, or a flanged cup can be dropped into a mating hole in surface 54 as necessary to hold instruments. Corner element 50 also includes other means for holding instruments, such as scissors or other implements characterized by an enlarged end, namely through passages 62 and 64. Corner element 50 also includes a receptacle for holding sheets of paper 66 that is mounted to the underside of corner element 50. The paper holder 66 has an open face 68 that is open to central region 26 of enclosure 10.

The interchangeable further corner element 52 (seen in FIG. 3) can be generally classified as a strainer and toy storage element. It includes an elemental center region 70 that is depressed with respect to the elemental top surface 72. At the bottom of the depression, a plurality of holes, one of which is typical hole 74, permits passage of a fluid medium into an inboard region of enclosure 10, whereby toys stored in the corner element are automatically separated from the sand or water. As used herein, the term "a fluid medium" includes any flowable material such as water or sand or other liquid, granular or like material that can occupy the enclosure and when poured will flow through the hole in the bottom of corner element 52.

Peripheral shelf 24 also includes an inboard shelf edge surface 27 that extends down from top surface 40 of the shelf. Shelf edge surface 27 likewise extends downward from top surface 40 along an interior edge 29 of the shelf and strengthens shelf 24 against bending.

Figure 3:
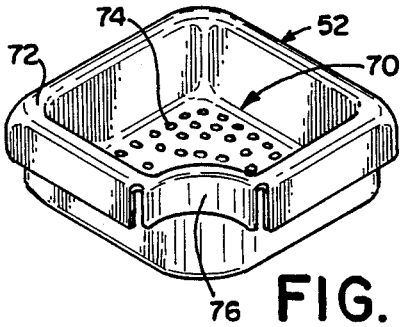
FIG. 3 illustrates a second corner element for outfitting the corners for sandbox or wading pool use; and, FIG. 4 is a section view taken along lines 4—4 in FIG. 1.

As shown in FIG. 3, straining corner element 52 includes an elemental lip 76 that depends from elemental top surface 72. Such elemental lip, in conjunction with shelf edge surface 27, forms a substantially continuous lip surface about a portion of central region 26 of enclosure 10 when the strainer 52 is disposed in the cut-out. As seen in FIG. 3, corner element 52 includes drain bottom 70 with drain holes 74 being large enough to allow sand granules to pass through easily, while retaining the toys therein.

Since enclosure 10 can be used as an artwork, paperwork, water or sand play enclosure, it is convenient to include closeable drain holes 90 and 92 in side wall 16 (as shown in FIG. 1). These drain holes may be closed by press-in plugs 94.

Figure 4:
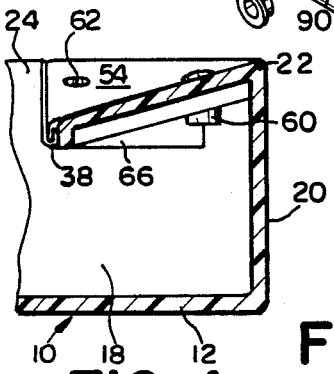

Now referring to FIG. 4, a cross section taken on lines 4—4 of FIG. 1 shows enclosure 10 with sloping peripheral shelf 24 and corner element 50. Top edge 22 is shown integral with sides 20 and 18 and bottom 12 U-shaped groove 38 is fitted with corner element 50. Corner element 50 has passage 62 for holding implements such as scissors which would have handles extending above surface 54 and cutting members suspended below surface 54. Cup 60 and paper holder 66 are seen suspended in corner element 50.

Preferably, enclosure 10 is made of molded one piece plastic and peripheral shelf 24 is integral with the rectilinear structure that includes side walls 14, 16, 18 and 20 as well as bottom 12.

The benefits of having removable corner elements are that crayons, pens and writing instruments can be placed in cup 60 of corner element 50, as well as paper placed in paper holder 66 while children play indoors or outdoors. Enclosure 10 may normally be kept either indoors or outdoors, or may be moved back and forth (i.e., outside for water, inside for paperwork). When the children stop playing with one functional attribute, corner element 50 can be simply removed from enclosure 10 and replaced. If used outdoors, corner element 50 can be removed daily to prevent damage to the paper, crayons, pens, etc. due to weather. It should be recognized that corner element 50 as shown can be modified such that it includes holders for paints, paint brushes and the like, and paper. The term "instruments" includes any paper, or like material, manipulating, cutting, folding and writing means. Those for coloring implements and paints, for example, can be used as writing instruments. Since peripheral shelf 24 acts not only as a child's seating area but also as a child's table, the placement and location of corner elements 50 and 52 are advantageous since children can remove the supplies from the corner elements, use shelf top surface 40 as a play surface on either side of the corner element, and replace the writing instruments and paper back into the corner elements for easy removal, storage and care by their supervisors, for example teachers at a nursery school or the like. With respect to corner element 52, other types of fluid play activities can be incorporated therein that would stimulate child's play.

The invention allows choice of artwork, paperwork, sand and water play. Paperwork play, especially cutting of paper, produces a product (bits of paper) that is appropriately confined in an enclosure of a type similar to a sandbox or wading pool. Children love to play in all these materials and the invention facilitates not only the play, but also the necessary activities of the children's supervisor to set up and store away the apparatus and materials to be used.

What is claimed is:

1. An enclosure for interchangeable use for artwork, paperwork, sand play and water play adapted for play by children, comprising:

an open top, rectilinear, box-like structure having short side walls as compared with a length and a width of said rectilinear structure;

a peripheral shelf inwardly extending from peripheral top edges of all sides of said open top of said rectilinear structure, a top surface thereof having an inward extension wide enough for a child's seat and a child's table surface, said peripheral shelf having at least one corner cut-out adjacent an intersection of two side walls of said rectilinear structure, said cut-out having a mouth open to a center region of said rectilinear and said peripheral shelf defining, about a periphery of said cut-out, a peripheral groove open to said top surface of said shelf; and, at least two discrete, interchangeable corner elements each having an elemental top surface of substantially the same size and shape as said cut-outs, each said corner element having depending side wall sections with a thickness and a height complementary to said peripheral groove of said cut-out such that when said removable corner elements are disposed in said cut-out, said side wall sections mate with said peripheral groove and said elemental top surface is coplanar with said top surface of said peripheral shelf, one of said two corner elements having means for holding instruments, and the other one of said two corner elements having a shallow, depressed elemental center region with holes permitting passage of a fluid medium into an inboard region of said rectilinear structure.

2. The enclosure as recited in claim 1, wherein said one corner element includes a cup means depending from said elemental top surface defining means for holding writing and cutting instruments.

3. The enclosure as recited in claim 1, wherein said elemental top surface of said one corner element includes holes for retaining said instruments.

4. The enclosure as recited in claim 1, wherein said other corner element is a strainer and toy retainer.

5. The enclosure as recited in claim 1, including two corner cut-outs diametrically opposed in said peripheral shelf.

6. The enclosure as recited in claim 1, wherein said one corner element includes a means for holding sheets of paper below said elemental top surface which has an open face open to said center region of said rectilinear structure.

7. The enclosure as recited in claim 1, wherein said peripheral shelf includes an inboard shelf edge surface depending from said top surface on an interior edge thereof and said other corner element includes an elemental lip depending from said elemental top surface such that when said other corner element is disposed in said cut-out, said elemental lip and said shelf edge surface form a substantially continuous lip surface about a portion of said center region of said rectilinear structure.

8. The enclosure as recited in claim 1, including at least one closeable drain hole in a lower region in a side wall of said rectilinear structure.

9. The enclosure as recited in claim 1, wherein said rectilinear structure and said peripheral shelf are integral plastic.

10. The enclosure as recited in claim 1, wherein the peripheral shelf slopes inwardly.

11. An enclosure for interchangeable play according to a plurality of functions, comprising:

an open top, rectilinear, box-like structures having short side walls as compared with a length and a width of said rectilinear structure;

a peripheral shelf sloping inwardly from peripheral top edges of all sides of said open top of said rectilinear structure, a top surface thereof having an inward extension wide enough for a child's seat and a child's table surface, said peripheral shelf having at least one corner cut-out adjacent an intersection of two side walls of said rectilinear structure, said cut-out having a mouth open to a center region of said rectilinear structure, and said peripheral shelf defining, about a periphery of said cut-out, a peripheral groove open to said top surface of said shelf; and a plurality of discrete, removable corner elements, each having an elemental top surface of substantially the same size and shape as said cut-outs, each said corner element having depending wall sections with a thickness and a height complementary to said peripheral groove of said cut-out such that when said removable corner elements are disposed in said cut-out, said side wall sections mate with said peripheral groove and said elemental top surface is coplanar with said top surface of said peripheral shelf.

12. The enclosure of claim 11, wherein one of said corner elements has means for receiving paper manipulating instruments.

13. The enclosure of claim 11, wherein one of said corner elements has means for receiving a supply of paper.

14. The enclosure of claim 11, wherein one of said corner elements has means for manipulating a material to be held in the enclosure.

15. The enclosure of claim 14, wherein the material is one of water, sand and paper.

16. The enclosure of claim 11, wherein one of said corner elements is a plain seat.

* * * * *